United States Patent [19]

Green et al.

[11] 4,220,295

[45] Sep. 2, 1980

[54] PACKAGED STRAND

[75] Inventors: William A. Green, Swanton, Ohio; William M. Goodrich, Humboldt, Tenn.; David R. Long, Anderson, S.C.

[73] Assignee: Owens-Corning Fiberglas Corporation, Toledo, Ohio

[21] Appl. No.: 13,694

[22] Filed: Feb. 21, 1979

[51] Int. Cl.[2] ..... B65H 55/00

[52] U.S. Cl. ..... 242/170; 206/410; 206/225; 242/172

[58] Field of Search ..... 206/410, 225; 229/DIG. 12; 242/129, 170, 171, 172, 179, 159, 125.3

[56] References Cited

U.S. PATENT DOCUMENTS

| | | | |
|---|---|---|---|
| 302,461 | 7/1884 | Worcester | 242/170 |
| 1,889,011 | 11/1932 | Baumhuter | 242/159 |
| 1,948,438 | 2/1934 | Burnett | 206/410 |
| 2,884,328 | 4/1959 | Johnson | 229/DIG. 12 |
| 3,731,792 | 5/1973 | Ralston | 206/410 |
| 3,915,301 | 10/1975 | Gray | 206/410 |

*Primary Examiner*—Herbert F. Ross

*Attorney, Agent, or Firm*—Ronald C. Hudgens; Philip R. Cloutier; Greg Dziegielewski

[57] ABSTRACT

A package and a method to produce said package are provided comprising a wound body of strand having an outer cylindrical portion; and an elastic membrane wound about the cylindrical portion of said body, the membrane being wound to a sufficient thickness and being stretched sufficiently to partially collapse when the strand is withdrawn from the body such that the membrane captures the strand of the outer cylindrical portion to retain such strand along said membrane until said strand is withdrawn from the package at a predetermined time.

4 Claims, 5 Drawing Figures

PACKAGED STRAND

BACKGROUND OF THE INVENTION

A number of systems have been developed for winding strand into a cylindrical package and subsequently encasing the wound package in a membrane to protect the strand and to facilitate withdrawal of the strand from the package.

A number of such systems included thermally shrinking a plastic or polymeric membrane over the outer surface of the wound body of the strand. Although such systems did improve the run-out capabilities of the package, a tendency for the outermost layer of the strand to collapse in a ball or "bird's nest" still existed. That is, as a strand was withdrawn from the package working from the inside diameter of the package to the outer diameter of the package, the outermost layers exhibited a tendency to collapse and tangle and, thus, preclude continuous operation and complete utilization of the strand.

Other systems incorporated an adhesive between the membrane and the outer layer of strand to retain the strand against the membrane wall. In a number of instances, the adhesive contaminated the strand, among other problems.

SUMMARY OF THE INVENTION

A package and a method for producing the package are provided comprising a wound body of strand having an outer cylindrical portion; and an elastic membrane wound about the cylindrical portion of said body, the membrane being wound to a sufficient thickness and stretched sufficiently to partially collapse as said strand is withdrawn from the body such that the membrane captures portions of the strand along the outer cylindrical portion of the body to retain the strand along said membrane until said strand is withdrawn from the package.

It is an object of this invention to provide an improved package system for encapsulating wound filamentary material.

It is another object of the present invention to provide a method for applying a membrane to a predetermined thickness in a predetermined stretched condition.

The foregoing, as well as other objects of the present invention, will become apparent to those skilled in the art in the following detailed description.

DESCRIPTION OF THE INVENTION

Figure 1:
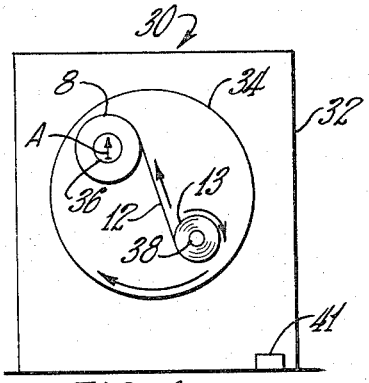
FIG. 1 is a semi-schematic front view of a system for wrapping an elastic membrane around a package of strand.
Figure 2:
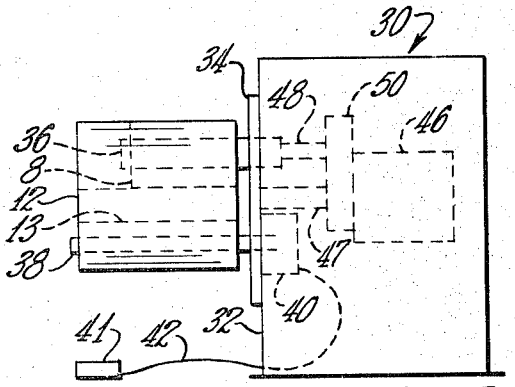
FIG. 2 is a side view of the system shown in FIG. 1.
Figure 3:
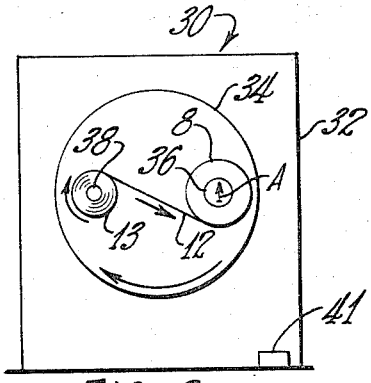
FIG. 3 is a front view of the system shown in FIG. 1 at a different point during package wrap.

As shown in FIGS. 1, 2 and 3, a cylindrically shaped, wound package of strand 8 having an external cylindrical portion 11 is positioned on wrapping means 30.

Elastic membrane 12 is supplied to package 8 from roll of membrane material 13. Elastic membrane 12 can be of any suitable material of a suitable thickness capable of being stretched to the proper extent. Polymeric membranes of such materials as polyvinylidene chloride and polyvinyl chloride are preferred in thickness from about 0.001 inch to about 0.003 inch.

Basically, the elastic membrane 12 is wound about the cylindrical portion 11 of wound body of strand 8, the membrane being applied to a sufficient thickness and being stretched or tensioned sufficiently to partially collapse when the strand is withdrawn from the interior of the body 8 such that the membrane 12 captures portions of the strand of the outer cylindrical portion 11 to retain such strand along the membrane until the strand is withdrawn from the package at a predetermined time.

Wrapping means 30 is comprised of a frame 32 and a rotatable member 34 associated therewith. The first collet 36 is rotatably journaled in member 34 and is adapted to receive body 8 thereon. Second collet 38 is rotatably journaled in member 34 and is adapted to receive roll 13 thereon. Member 34 is adapted to be rotated by motor 46. Positioning means or gear train 50, which can be attached to the housing of motor 46, is joined with shaft 48 of collet 36 such that as member 34 is rotated, body 8 and collet 36 maintain the same general unrotated orientation with respect to frame 32. As can be seen by FIGS. 1 and 3 arrow A, which points vertically upward on package 8 in FIG. 1, remains pointing vertically upward completely throughout the rotation of member 34.

A second collet 38, which is rotatably journaled in member 34, is attached to adjustable braking means 40 to apply a predetermined amount of drag to second collet 38 such that membrane 12 is wrapped about body 8 under a predetermined amount of tension to stretch membrane 12. Brake means 40 can be of any suitable type such as a pneumatic or electrodynamic brake as is known in the art. Brake means 40 is adjustably controlled by control means 41 via connection 42 as is known in the art.

Alternatively, wound body 8 can be mounted on a driven rotatable collet. Membrane 12 can be pulled from a roll mounted on another collet as the body 8 is rotated. Also, the roll and the collet associated therewith could have a brake means to apply sufficient amount of tension to membrane 12 as it is being wound around the cylindrical portion 11 of body 8.

Figure 4:
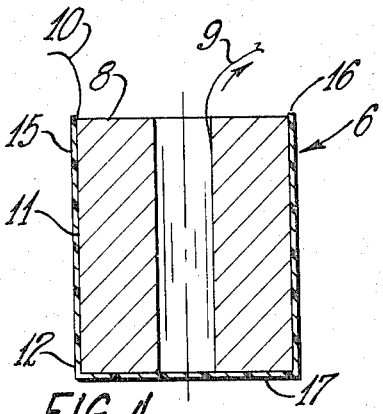
FIG. 4 is a cross-sectional view of a package according to the principles of this invention.

As shown in FIG. 4, one end 16 of package 6 is substantially open with the opposite end 17 being substantially closed. It is believed that membrane 12 should project no further than approximately $\frac{1}{2}$ inch radially inward from the cylindrical shell 15 at the open end of the package to facilitate complete, continuous run-out of the strand. Preferably, first strand end 9 positioned in the hollow core of body 8 is adapted to be pulled out through the open end 16 of the package 6. Second strand end 10 can be located along the external cylindrical portion 11 of body 8. For continuous operation, end 10 can be tied to another end of a second package to permit continuous operation.

FIG. 4 is drawn in a slightly exploded view; the cylindrical shell 15 formed by membrane 12 according to the principles of this invention is in intimate compressive contact with the external cylindrical portion 11 of body 8.

Closed end 17 can be formed by supplying a sheet of membrane 12 substantially longer than the length of body 8, as shown in FIG. 2, and folding the excess membrane over the end to form closed end 17. Open end 16 is formed by positioning one end of body 8 and one end of roll 13 in a common vertical plane and maintaining this relationship during wrapping, as can be seen in FIG. 2.

Figure 5:
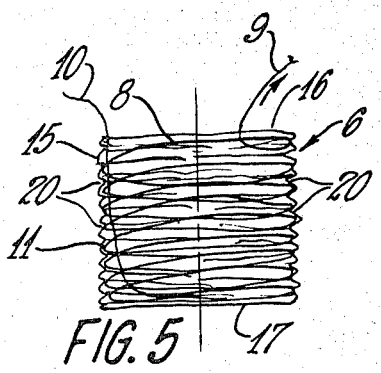
FIG. 5 is a front view of the package just prior to the complete run-out of the strand from the package.

As shown in FIG. 5, cylindrical shell 15 develops a plurality of undulations or crinkled sections or ridges due to the relaxation of the tension on membrane 12 as well as the weight of the shell 15 and unsupported outer layers of strand as the strand is almost completely withdrawn from package 6. The crinkles or corrugations 20 have been found to mechanically grasp or crimp portions of the strand at the outer cylindrical portion of body 8 to retain such portions of the strand along the shell 15 of membrane 12 until the strand is withdrawn from the package in a predetermined manner.

It has been found that shell 15 collapses along its axial length in an amount within the range from about 10% to about 50% of the original package height or length. A partial collapse within a range from about 20% to 40% is preferred. The amount of radical contraction of shell 15 is substantially less.

It has been found that a tensile force within the range from about 2 to about 4 pounds applied to membrane 12 as it is being wound around body 8 for a plurality of convolutions within the range from about 2 to about 4 convolutions employing a membrane having a width within the range from about 17 to 24 inches and having a thickness within the range from about 0.001 to about 0.003 inch applied to a package of wound glass strand approximately 11 inches long and 12 inches in diameter provides a package having improved strand run-out characteristics.

As such, the tension applied to membrane 12 during winding should be within a range from about 0.08 pounds per inch of width of membrane to about 0.24 pounds per inch of width of membrane for acceptable results, wherein from 2 to 4 convolutions of membrane are wound about about 8. The number of wraps of membrane is dependent upon the characteristics of the particular membrane and body of strand.

If the shell 15 were wound too thick, the tendency for the shell to collapse along its length would be substantially reduced. Therefore, it is necessary that the number of convolutions of membrane not be excessive.

Package 6 produced according to the instant invention provides, improved strand run-out characteristics, in the absence of "heat-shrinking" the membrane 12 as is known in the art. It has been found that "heat-shrinking" a polymeric membrane generally provides a shell or membrane not having the proper collapse characteristics to sufficiently capture the strand between the folds to retain the strand along the membrane.

Also, the membrane 12 should be of the type having a static electrical charge adapted to attract the strand to help retain the strand along membrane 12.

It is apparent that within the scope of the invention, modifications and different arrangements can be made other than as herein disclosed. The present disclosure is merely illustrative with the invention comprehending all variations thereof.

We claim:

1. A package comprising:

a wound body of strand having an outer cylindrical portion; and an elastic membrane convolutely wound about the cylindrical portion of said body from about 2 to about 4 times, the membrane being of a sufficient thickness and being stretched sufficiently to partially collapse as the strand is withdrawn from the interior of the body such that the membrane mechanically captures the strand of the outer cylindrical portion to retain such strand along said membrane until said strand is withdrawn from the package at a predetermined time.

2. A package comprising:

a wound body of strand having an outer cylindrical portion; and an elastic membrane convolutely wrapped about said body from about 2 to about 4 times and having a length at least substantially equal to the height of said outer cylindrical portion wound about the cylindrical portion of said body positioned such that a single layer of said membrane substantially covers all of said cylindrical portion, the membrane being of a sufficient thickness and being stretched sufficiently around said cylindrical portion to partially collapse while retaining a generally cylindrical shape as the strand is withdrawn from the interior of the body such that the membrane mechanically crimps the strand of the outer cylindrical portion between the folds of the membrane as it collapses to retain such strand along said membrane until said strand is withdrawn from the package at a predetermined time to facilitate complete withdrawl of said strand from said package.

3. The package of claim 1 wherein said membrane is statically charged such that the strand is attracted to said membrane.

4. The package of claims 1 or 2 wherein said membrane collapses along the length of the cylindrical portion within a range from about 10% to about 50% of the package length prior to initiation of strand withdrawal.

* * * * *